US009458860B2

(12) United States Patent
Uehara

(10) Patent No.: US 9,458,860 B2
(45) Date of Patent: Oct. 4, 2016

(54) FAN WITH SOUND-MUFFLING BOX

(75) Inventor: Akimasa Uehara, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 208 days.

(21) Appl. No.: 14/117,852

(22) PCT Filed: May 21, 2012

(86) PCT No.: PCT/JP2012/003298

§ 371 (c)(1),
(2), (4) Date: Nov. 15, 2013

(87) PCT Pub. No.: WO2012/169125

PCT Pub. Date: Dec. 13, 2012

(65) Prior Publication Data

US 2014/0079569 A1 Mar. 20, 2014

(30) Foreign Application Priority Data

Jun. 9, 2011 (JP) ..... 2011-128792

(51) Int. Cl.
*F04D 29/66* (2006.01)
*F04D 29/42* (2006.01)
(Continued)

(52) U.S. Cl.
CPC ..... *F04D 29/664* (2013.01); *F04D 17/162* (2013.01); *F04D 29/4226* (2013.01); *F01N 1/24* (2013.01); *F24F 2013/242* (2013.01)

(58) Field of Classification Search
CPC .... F04D 29/66; F04D 29/664; F04D 17/162; F04D 29/4226; F04D 29/70; F04D 29/701; F01N 1/24; B60H 2001/006; F24F 1/12; F24F 13/242; F24F 2013/242
USPC ..... 417/423.7; 415/119
See application file for complete search history.

(56) References Cited

U.S. PATENT DOCUMENTS 2,684,690 A * 7/1954 Lee ..... D21F 1/02 137/601.08
3,120,876 A * 2/1964 Lirette ..... F02M 35/14 181/229

(Continued)

FOREIGN PATENT DOCUMENTS

CN 101688679 3/2010
JP 57-80698 U 5/1982

(Continued)

OTHER PUBLICATIONS

International Search Report of PCT Application No. PCT/JP2012/003298 dated Aug. 21, 2012.

(Continued)

*Primary Examiner* — Bryan Lettman
*Assistant Examiner* — Connor Tremarche
(74) *Attorney, Agent, or Firm* — Panasonic IP Management; Kerry S. Culpepper

(57) ABSTRACT

A fan with a sound muffling box includes a box having a box inlet port and a box outlet port located on opposite sides from each other; and a double suction centrifugal fan encased in the box. The centrifugal fan includes a motor, a discharge port, an impeller, a scroll, and a casing side plate. The casing side plate has a motor-side inlet port, and an opposite-motor-side inlet port opposite to the motor-side inlet port with respect to the impeller. The discharge port is inclined with respect to the box outlet port. The fan with the sound muffling box further includes a sound insulating board disposed on the box inlet port in such a manner as to hide the opposite-motor-side inlet port and also to divide the box inlet port into plural regions when the inside of the box is viewed from the box inlet port.

8 Claims, 10 Drawing Sheets

(51) Int. Cl.

| | |
|---|---|
| ***F04D 17/16*** | (2006.01) |
| *F24F 13/24* | (2006.01) |
| *F01N 1/24* | (2006.01) |

(56) References Cited

U.S. PATENT DOCUMENTS

| | | | | |
|---|---|---|---|---|
| 2010/0074728 | A1* | 3/2010 | Sinzaki | F04D 29/66 415/119 |
| 2010/0183425 | A1* | 7/2010 | Sinzaki | F04D 25/166 415/60 |
| 2010/0189547 | A1* | 7/2010 | Shirahama | F04D 29/664 415/119 |

FOREIGN PATENT DOCUMENTS

| | | |
|---|---|---|
| JP | 4-203398 | 7/1992 |
| JP | 10-073304 | 3/1998 |
| JP | 2002-156139 | 5/2002 |
| JP | 2002-268646 | 9/2002 |
| JP | 2007-211732 | 8/2007 |
| JP | 2008-223661 | 9/2008 |
| JP | 2009-250203 | 10/2009 |

OTHER PUBLICATIONS

English Translation of Chinese Search Report dated Jul. 16, 2015 for the related Chinese Patent Application No. 201280025813.5.

* cited by examiner

FAN WITH SOUND-MUFFLING BOX

TECHNICAL FIELD

The present invention relates to a fan with a sound muffling box.

BACKGROUND ART

A conventional fan with a sound muffling box, which is a fan encased in a sound muffling box such as a ventilation fan, reduces suction noise as follows. A flow-dividing sound muffler is provided on the rear face of the fan casing of a double suction fan encased in a sound muffling box. Suctioned air flow is divided into two streams: one flowing through a motor-side air passage and the other through an opposite-to-motor-side air passage. The amount of air drawn into each air passage is adjusted to make the sound muffling material have an effective sound-absorbing function (see, for example, Patent Literature 1).

The reduction of the suction noise of the fan with the sound muffling box will now be described with reference to FIG. 10, which is a plan sectional view of the conventional fan with the sound muffling box. As shown in FIG. 10, in the conventional fan, box 101 includes fan casing 103 with impeller 102, and double suction centrifugal fan 105 with motor 104.

When impeller 102 rotates, air is drawn through box inlet port 106 of box 101, passes through double suction centrifugal fan 105, and exhausted from box outlet port 107. On the rear face of fan casing 103, there is attached flow-dividing sound muffler 108. Flow-dividing sound muffler 108 divides the air drawn through box inlet port 106 into two streams: one flowing through motor-side air passage 109 and the other through opposite-to-motor-side air passage 110.

Flow-dividing sound muffler 108 has an opening portion 111 formed near opposite-to-motor-side air passage 110 on the box inlet port 106 side. The opening portion 111 enables a larger amount of air to flow into opposite-to-motor-side air passage 110 than into motor-side air passage 109. Motor-side air passage 109 is prone to cause flow noise because air flow is obstructed by motor 104 and motor mounting leg 112. The generation of this flow noise, however, is reduced by forcing a larger amount of air flow to flow through opposite-to-motor-side air passage 110.

Thus, in this conventional fan with the sound muffling box, the flow noise caused in motor-side air passage 109 is suppressed by dividing the suctioned air flow into plural streams at the rear face of fan casing 103. However, in order to achieve the intended objective of reducing the suction noise in box 101, it is necessary to make flow-dividing sound muffler 108 large enough as a sound-muffling air passage. This requires enlarging the distance between box inlet port 106 and the rear face of fan casing 103, thereby increasing the material cost. Furthermore, it becomes difficult to miniaturize box 101.

In a fan with a sound muffling box designed as a type to handle a large amount of air flow, box inlet port 106 is generally connected to a rectangular duct. In this case, the cross-sectional area of the air passage of the rectangular duct, i.e. the opening area of box inlet port 106 is larger than the projected area of the rear face of fan casing 103 viewed from box inlet port 106. Therefore, part of the air flow drawn through box inlet port 106 reaches double suction centrifugal fan 105 without colliding with the rear face of fan casing 103, causing flow-dividing sound muffler 108 to be ineffective.

CITATION LIST

Patent Literature

Patent Literature 1: Japanese Unexamined Patent Publication No. 2002-156139

SUMMARY OF THE INVENTION

The fan with a sound muffling box of the present invention includes a box having a box inlet port and a box outlet port located on opposite sides from each other; and a double suction centrifugal fan encased in the box. The double suction centrifugal fan includes a motor, a discharge port, an impeller, a scroll, and a casing side plate. The casing side plate has a motor-side inlet port, and an opposite-to-motor-side inlet port opposite to the motor-side inlet port with respect to the impeller. The discharge port is inclined with respect to the box outlet port, and the impeller is driven by the motor. The fan with the sound muffling box further includes a sound insulating board disposed on the box inlet port in such a manner as to hide the opposite-to-motor-side inlet port when the inside of the box is viewed from the box inlet port and also to divide the box inlet port into plural regions.

With this configuration, the air drawn through the box inlet port is divided in such a manner that a larger amount of air flows into the opposite-to-motor-side air passage than into the motor-side air passage. This results in suppressing the flow noise caused by the motor and the motor mounting leg disposed in the motor-side air passage. On the other hand, the suction noise caused at the opposite-to-motor-side inlet port reverberates in the box due to the presence of the sound insulating board, thereby being suppressed from propagating to the outside.

DESCRIPTION OF EMBODIMENT

An exemplary embodiment of the present invention will now be described with reference to drawings.

Embodiment

Figure 1:
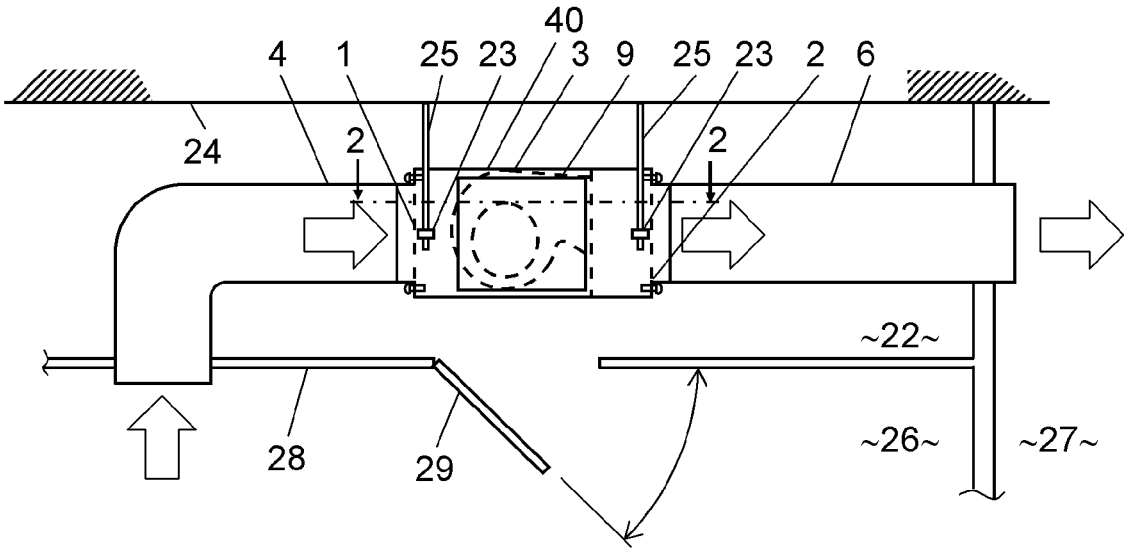
FIG. 1 is a side view of a fan with a sound muffling box according to an exemplary embodiment of the present invention when the fan is in an installed position.

FIG. 1 is a side view of a fan with a sound muffling box according to an exemplary embodiment of the present invention when the fan is in an installed position. As shown in FIG. 1, fan 40 with a sound muffling box has box inlet port 1 on the inlet side, box outlet port 2 on the outlet side, double suction centrifugal fan 9 inside box 3, and hooks 23 on the outer surface of box 3. Fan 40 is installed on attic floor 22 with hooks 23 fixed to hanging bolts 25, which are embedded in ceiling plate 24.

In attic floor 22, box inlet port 1 is connected to suction-side duct 4, whereas box outlet port 2 is connected to exhaust-side duct 6. When double suction centrifugal fan 9 is operated, the air in indoor 26 environment passes through suction-side duct 4, double suction centrifugal fan 9, and exhaust-side duct 6, and is then exhausted to outdoor 27 environment. Attic floor 22 and indoor 26 are separated by ceiling member 28. Ceiling member 28 has ceiling access door 29 under fan 40.

Figure 2:
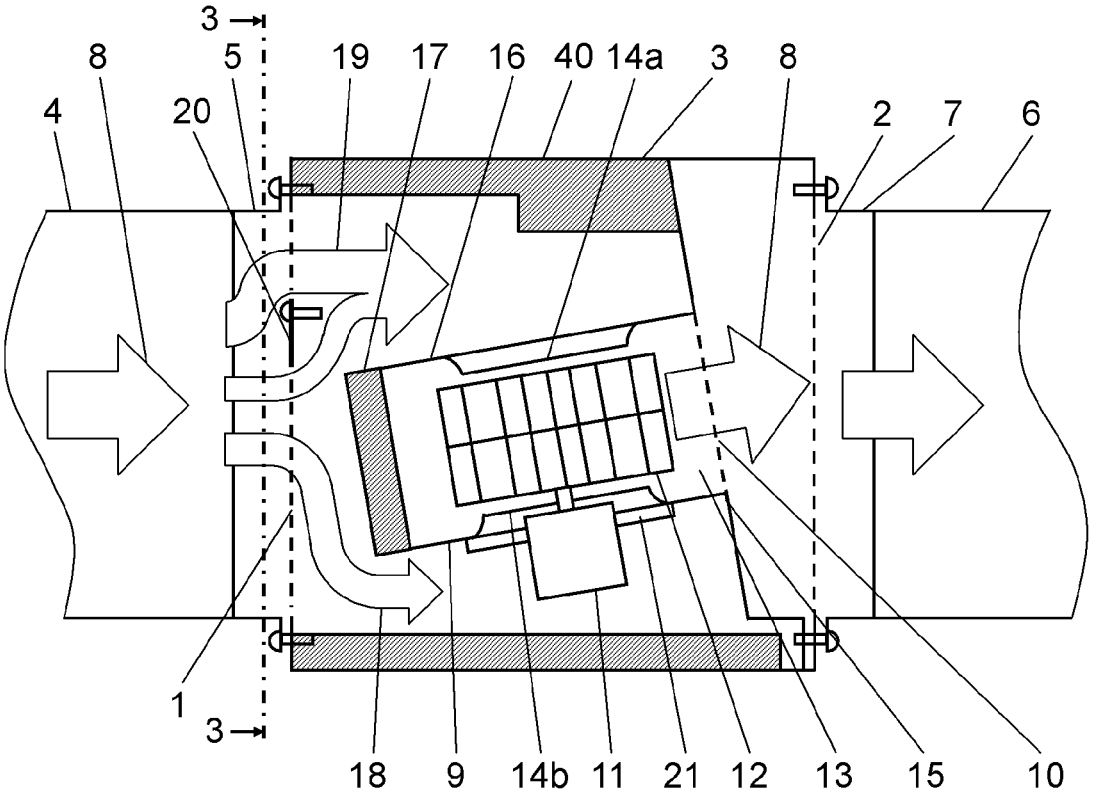
FIG. 2 is a sectional view taken along line 2-2 of FIG. 1.
Figure 3:
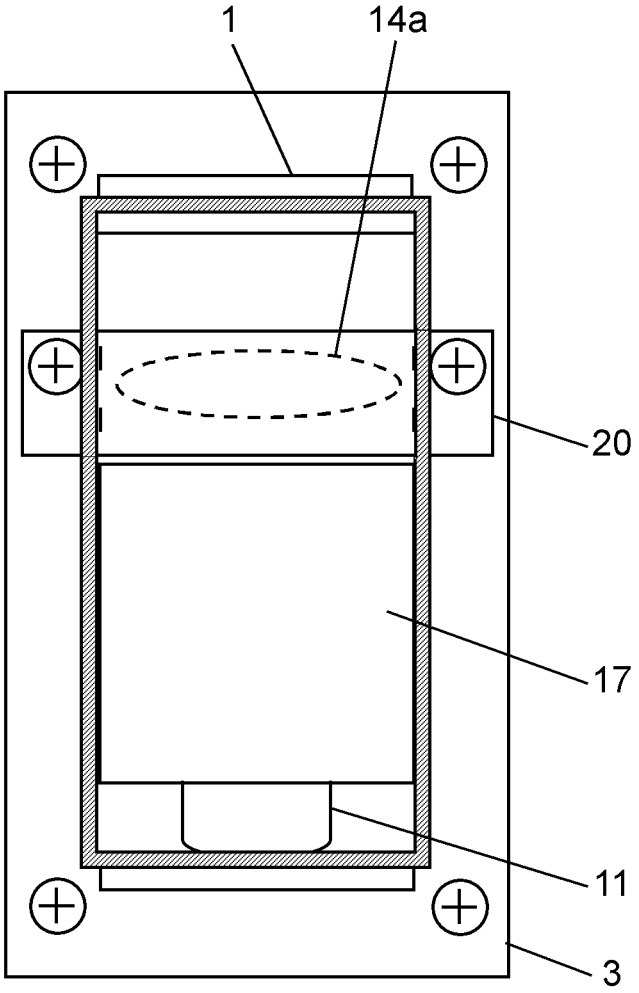
FIG. 3 shows a first internal structure (a sectional view taken along line 3-3 of FIG. 2) of the fan with the sound muffling box according to the exemplary embodiment of the present invention.

FIG. 2 is a sectional view taken along line 2-2 of FIG. 1. FIG. 3 shows a first internal structure (a sectional view taken along line 3-3 of FIG. 2) of the fan with the sound muffling box according to the exemplary embodiment of the present invention. As shown in FIGS. 2 and 3, box inlet port 1 and box outlet port 2 are formed on opposite sides of box 3. In box 3, box inlet port 1 has suction-side square flange 5 to be connected to suction-side duct 4, whereas box outlet port 2 has exhaust-side square flange 7 to be connected to exhaust-side duct 6. Inside box 3, there is formed air passage 8 extending between box inlet port 1 and box outlet port 2.

Double suction centrifugal fan 9 includes motor 11, discharge port 10, impeller 12, scroll 13, and casing side plate 15 which forms fan casing 16. Impeller 12 is fixed to and driven by motor 11. Casing side plate 15 has motor-side inlet port 14*b*, and opposite-to-motor-side inlet port 14*a* opposite to motor-side inlet port 14*b* with respect to impeller 12.

In air passage 8, discharge port 10 of double suction centrifugal fan 9 is inclined with respect to box outlet port 2. In other words, opposite-to-motor-side inlet port 14*a* is inclined toward box inlet port 1.

Double suction centrifugal fan 9 further includes sound absorber 17 disposed on the rear face of fan casing 16. The arrangement of sound absorber 17 and inclined double suction centrifugal fan 9 divides air passage 8 into motor-side air passage 18 on the side having motor 11, and opposite-to-motor-side air passage 19 on the side not having motor 11. Double suction centrifugal fan 9 further includes sound insulating board 20, which is disposed on box inlet port 1 and screw-fixed to box 3 in such a manner as to hide opposite-to-motor-side inlet port 14*a* when the inside of box 3 is viewed from box inlet port 1. Thus, sound insulating board 20 divides box inlet port 1 into plural regions.

The following is a description of actions and effects of fan 40 having the above-described configuration. The air flow generated by impeller 12 driven and rotated by motor 11 is drawn through suction-side duct 4 and box inlet port 1 and into box 3. At box inlet port 1, the air flow is drawn into box 3 after being divided by sound insulating board 20 into two streams: one on the motor 11 side and the other on the side opposite to the motor 11 side. In box 3, the air flow drawn in on the motor 11 side collides with double suction centrifugal fan 9 and is divided into two streams: one flowing toward motor-side air passage 18, and the other flowing toward opposite-to-motor-side air passage 19. Opposite-to-motor-side inlet port 14*a* is inclined toward box inlet port 1, and double suction centrifugal fan 9 is disposed with inclination. As a result, a larger amount of air flow flows into opposite-to-motor-side air passage 19 than into motor-side air passage 18.

Motor-side air passage 18 is prone to cause flow noise because air flow is obstructed by motor 11 and motor mounting leg 21. The generation of this flow noise, however, is reduced by forcing a larger amount of air flow to flow into opposite-to-motor-side air passage 19 than into motor-side air passage 18.

Since motor-side inlet port 14*b* is inclined toward box outlet port 2, when the inside of box 3 is viewed from box inlet port 1, motor-side inlet port 14*b* is hidden by fan casing 16. As a result, the flow noise caused by motor 11 and motor mounting leg 21 is suppressed from propagating to the outside. On the other hand, since opposite-to-motor-side inlet port 14*a* is inclined with respect to box inlet port 1, the suction noise of double suction centrifugal fan 9 is prone to propagate to the outside. The suction noise, however, reverberates inside box 3 due to the presence of sound insulating board 20 provided to hide opposite-to-motor-side inlet port 14*a*. As a result, the sound-muffling air passage efficiently absorbs noise, thereby suppressing the flow noise from propagating to the outside.

As described above, fan 40 according to the exemplary embodiment of the present invention has a high ability to blow air even if it is designed as a type to handle a large amount of air flow and to be connected to a rectangular duct. This configuration reduces the distance between box inlet port 1 and the rear face of fan casing 16, thereby achieving both the miniaturization of fan 40 and the reduction of the suction noise.

Figure 4:
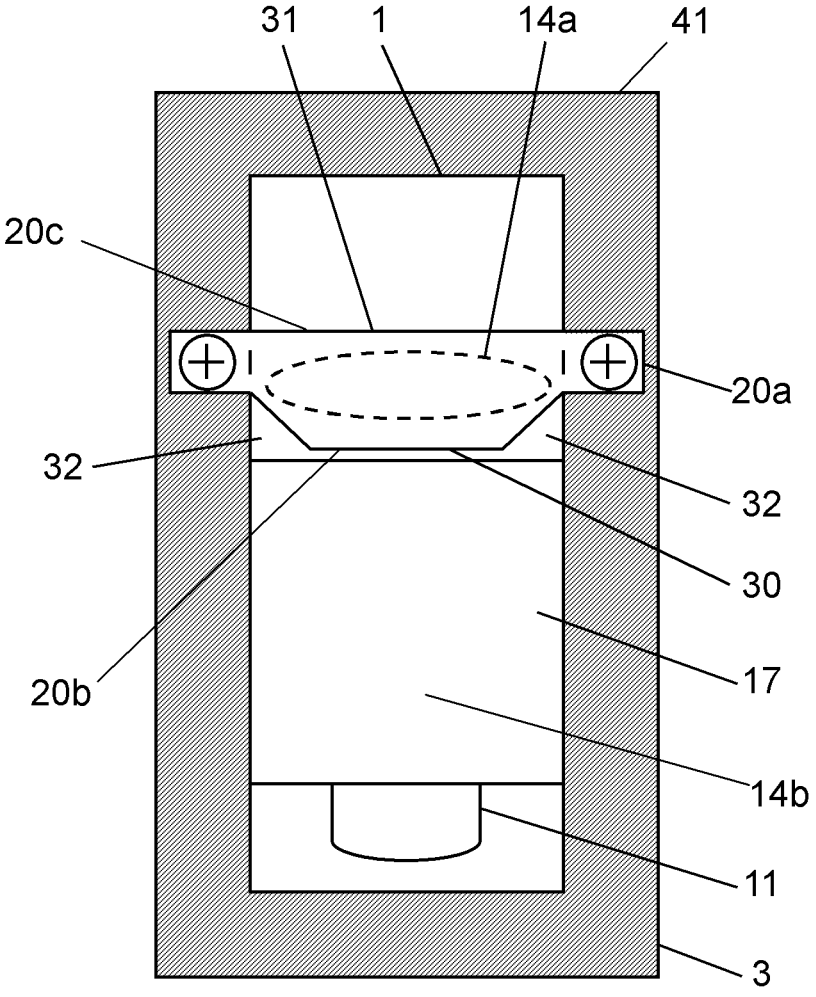
FIG. 4 shows a second internal structure of the fan with the sound muffling box according to the exemplary embodiment.

FIG. 4 shows a second internal structure of the fan with the sound muffling box according to the exemplary embodiment of the present invention. As shown in FIG. 4, sound insulating board 20*a* increases in area from near side 20*b* of motor-side inlet port 14*b* toward far side 20*c*. More specifically, sound insulating board 20*a* has motor-side end 30, which is a long side on the motor 11 side, and opposite-to-motor-side end 31, which is a long side on the side opposite to the motor 11 side. Sound insulating board 20*a* is a trapezoid having motor-side end 30 and opposite-to-motor-side end 31, wherein the motor-side end 30 is shorter than opposite-to-motor-side end 31.

The following is a description of actions and effects of fan 41 having the above-described configuration. Since motor-side end 30 is shorter than opposite-to-motor-side end 31, a smaller area of opposite-to-motor-side inlet port 14*a* is hidden by sound insulating board 20*a* than when viewed from box inlet port 1 shown in FIG. 2. In other words, in box inlet port 1, the area having a low sound-insulating effect is formed as opening 32. As a result, box inlet port 1 has a large opening area, thereby suppressing pressure loss, while keeping the sound-insulating effect.

Thus, in fan 41 shown in FIG. 4, sound insulating board 20*a* is affixed to box inlet port 1 so as to suppress pressure loss, thereby preventing a decrease in the ability to blow air.

Sound insulating board 20*a* may be semicircular (or bow-shaped), and the diameter (or the string) may be positioned on the side opposite to motor 11, i.e. may correspond to opposite to-motor-side end 31 when viewed from box inlet port 1.

Figure 5:
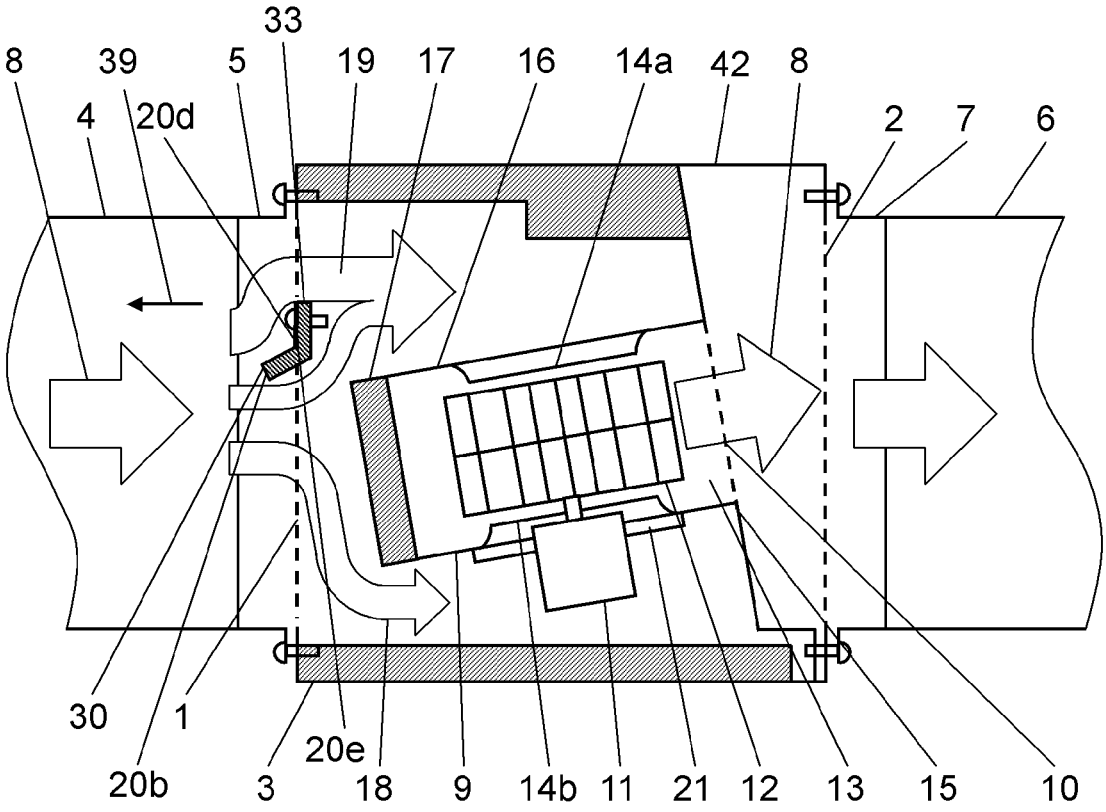
FIG. 5 is a plan sectional view of the fan with the sound muffling box according to the exemplary embodiment having a different configuration.

FIG. 5 is a plan sectional view of the fan with the sound muffling box according to the exemplary embodiment of the present invention. As shown in FIG. 5, sound insulating board 20*d* has motor-side end 30, which is positioned on near side 20*b* of motor-side inlet port 14*b* and is bent in opposite direction 39 to the direction from box inlet port 1 toward box outlet port 2. The fan with the sound muffling box further includes sound absorber 33 affixed to face 20*e* of sound insulating board 20*d*, face 20*e* being opposite to double suction centrifugal fan 9.

The following is a description of actions and effects of fan 42 having the above-described configuration. As described above, the air flow generated by impeller 12 driven and rotated by motor 11 is drawn through suction-side duct 4 and box inlet port 1 and into box 3. At box inlet port 1, the air flow is drawn into box 3 after being divided by sound insulating board 20*d* into two streams: one on the motor 11 side and the other on the side opposite to the motor 11 side. Motor-side end 30 bent toward the outside of box 3 enables the air flow that has collided with sound insulating board 20*d* to be divided smoothly into two streams in the horizontal direction, thereby leading a larger amount of air flow toward opposite-to-motor-side inlet port 14*a*.

Sound insulating board 20*d*, which is affixed with sound absorber 33, also provides a sound-absorbing effect. As a result, the suction noise of double suction centrifugal fan 9 is efficiently absorbed, thereby being suppressed from propagating to the outside.

Figure 6:
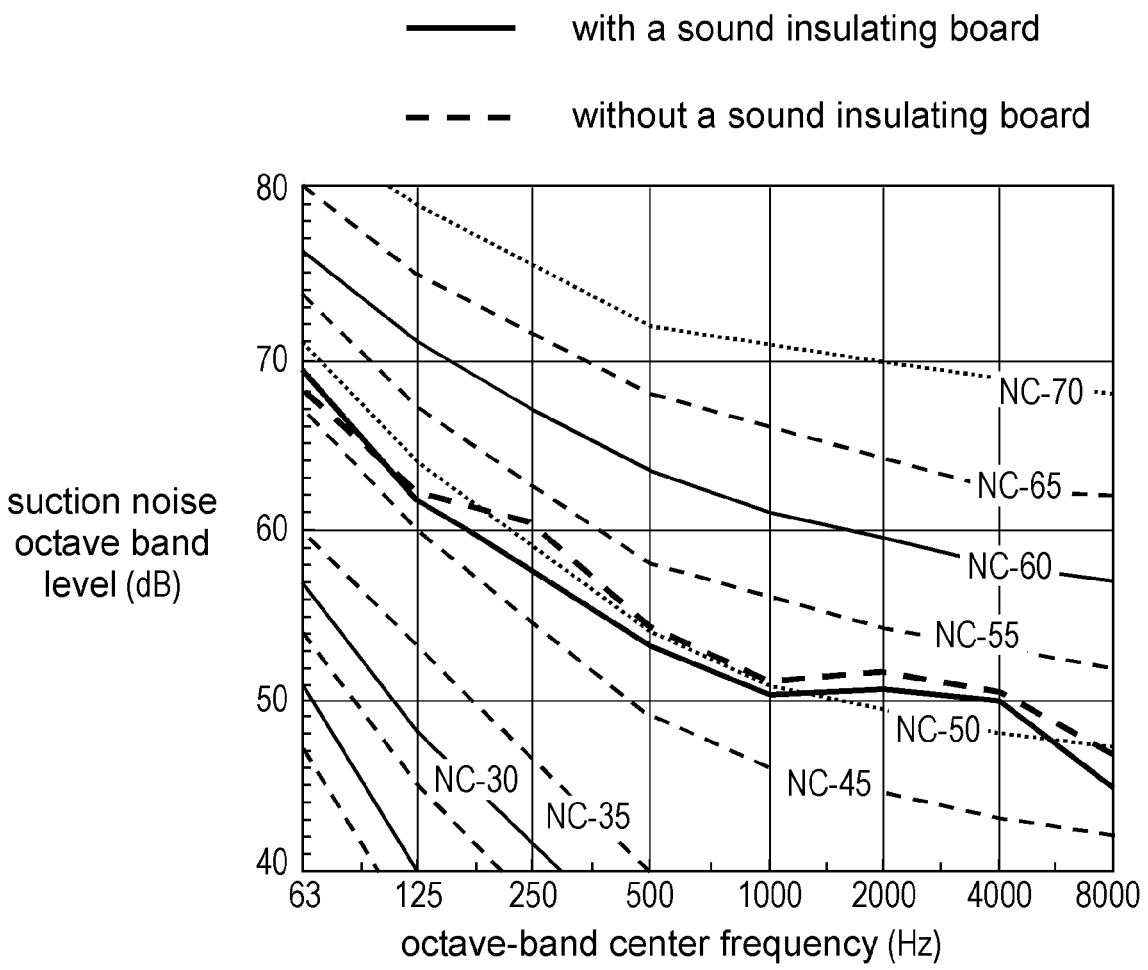
FIG. 6 is an NC graph comparing suction noise depending on the presence or absence of a sound insulating board in the fan with the sound muffling box according to the exemplary embodiment.

FIG. 6 is an NC graph comparing suction noise depending on the presence or absence of a sound insulating board in the fan with the sound muffling box according to the exemplary embodiment of the present invention. As shown in FIG. 6, sound-muffling effect is observed to be higher by 0.5 to 1 dB in the entire frequency band when sound insulating board 20 is present than when sound insulating board 20 is absent.

Figure 7:
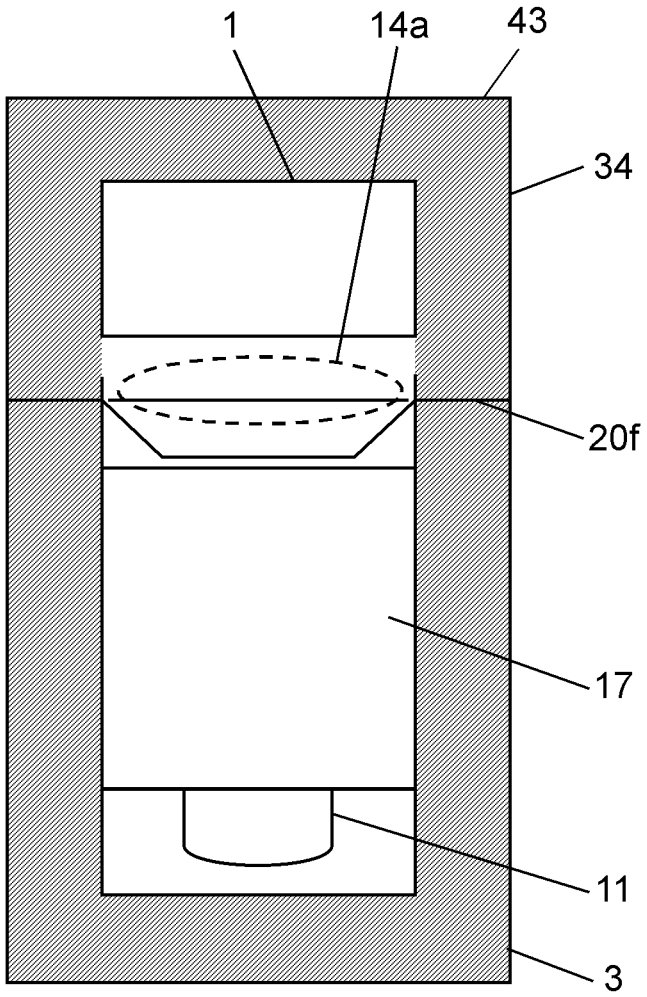
FIG. 7 shows a third internal structure of the fan with the sound muffling box according to the exemplary embodiment.

FIG. 7 shows a third internal structure of the fan with the sound muffling box according to the exemplary embodiment of the present invention. As shown in FIG. 7, sound insulating board 20*f* is formed integrally with outer plate 34, which is formed on side faces of box 3 and bent to form board 20*f*.

The following is a description of actions and effects of fan 43 having the above-described configuration. If sound insulating board 20*f* is screw-fixed to box 3, the suctioned air flow collides with the gap between sound insulating board 20*f* and box 3, which sometimes causes collision noise (popping noise). When, however, sound insulating board 20*f* is formed integrally with outer plate 34, no gap is formed between sound insulating board 20*f* and box 3, and hence, no collision noise (popping noise) is caused. This configuration also reduces both the number of components and the time required for screw-fixation.

Thus, fan 43 can suppress the generation of suction noise, and be easily assembled.

Figure 8:
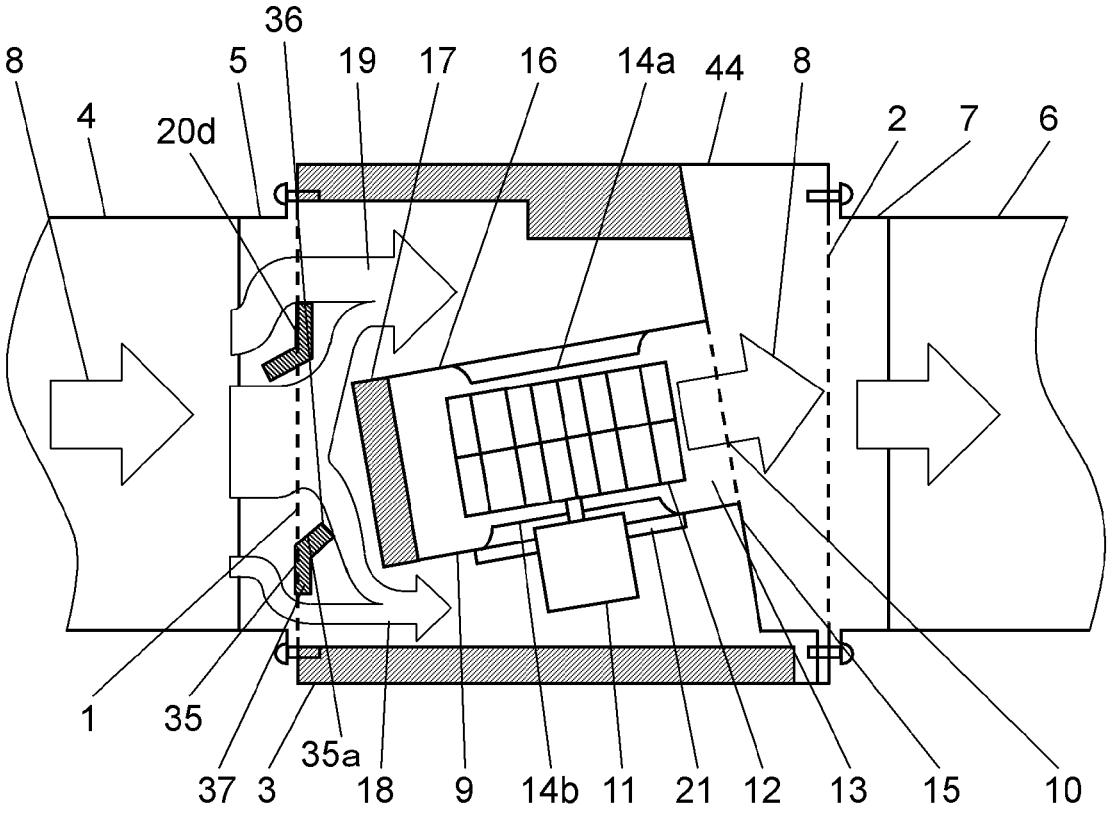
FIG. 8 is a plan sectional view of the fan with the sound muffling box according to the exemplary embodiment having a further different configuration.

FIG. 8 is a plan sectional view of the fan with the sound muffling box according to the exemplary embodiment of the present invention having a further different configuration. As shown in FIG. 8, fan 44 includes rectangular airflow guide 35 on box inlet port 1, airflow guide 35 being closer to motor 11 than sound insulating board 20*d*. Airflow guide 35 has end 36, which is on the sound insulating board 20*d* side and bent toward the inside of box 3. Fan 44 further includes sound absorber 37 affixed to face 35*a* of airflow guide 35, face 35*a* being opposite to double suction centrifugal fan 9.

The following is a description of actions and effects of fan 44 having the above-described configuration. Airflow guide 35 enables suction noise on the motor 11 side of double suction centrifugal fan 9 to reverberate in box 3. Furthermore, bent end 36 enables the air flow drawn in on the motor 11 side to be divided into two streams in the horizontal direction so as to adjust the amount of air flow between opposite-to-motor-side air passage 19 and motor-side air passage 18. Airflow guide 35 whose face 35*a* opposite to double suction centrifugal fan 9 is affixed with sound absorber 37 also provides a sound-absorbing effect. As a result, the suction noise of double suction centrifugal fan 9 is efficiently absorbed, thereby being suppressed from propagating to the outside.

Thus, the configuration of fan 44 can further prevent a decrease in the ability to blow air, thereby achieving both the miniaturization of fan 44 and the reduction of the suction noise.

Figure 9:
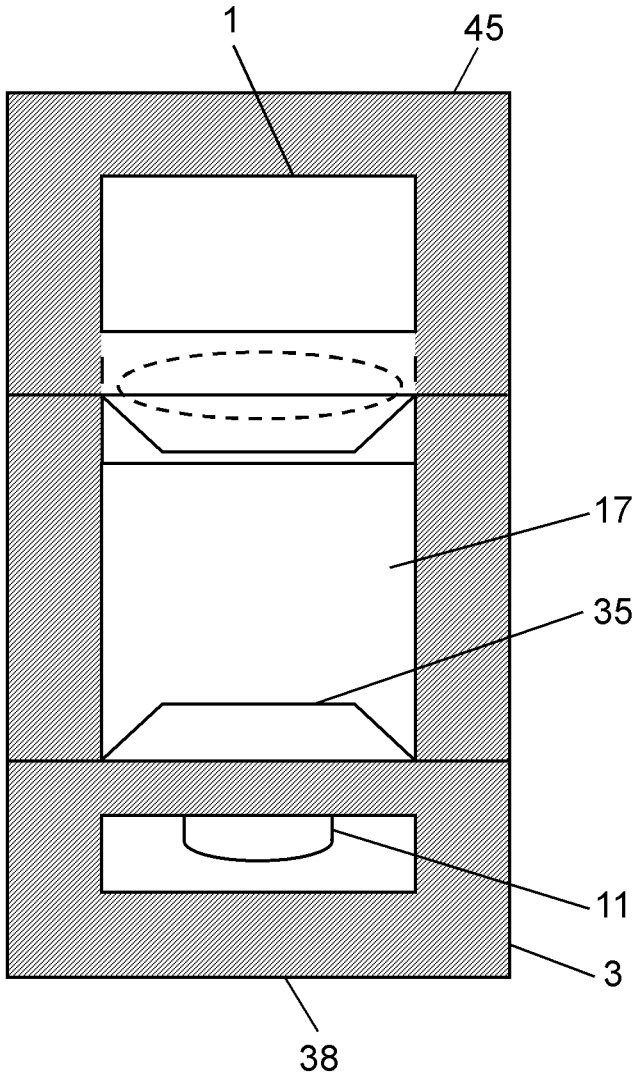
FIG. 9 shows a fourth internal structure of the fan with the sound muffling box according to the exemplary embodiment.
Figure 10:
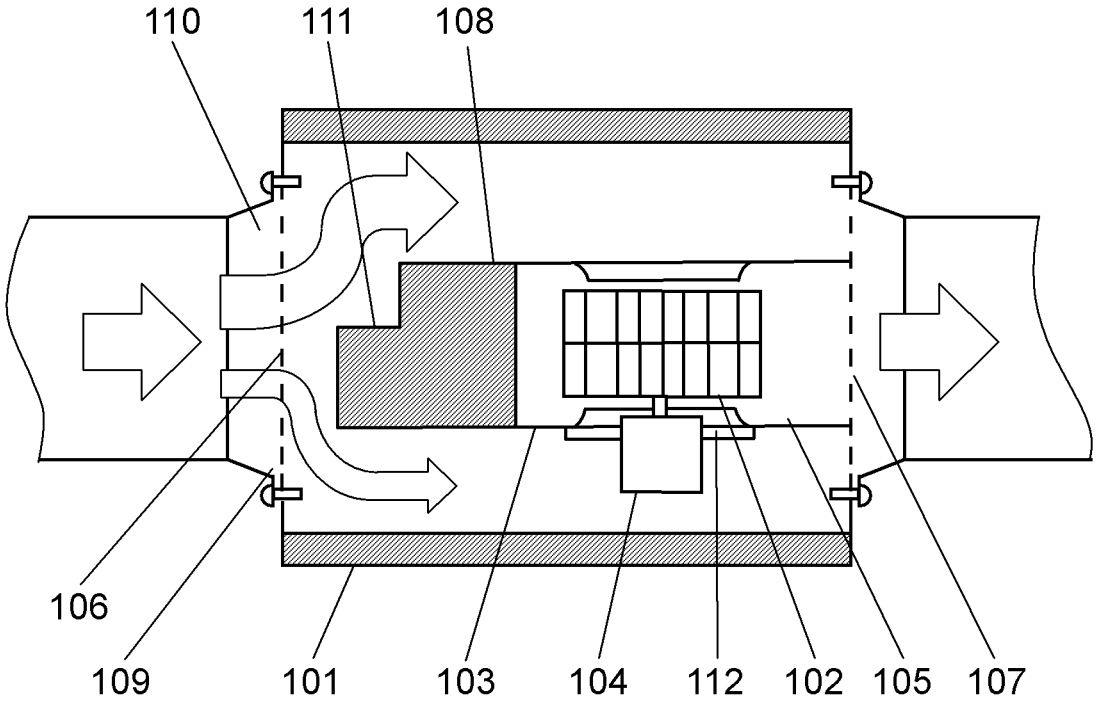
FIG. 10 PRIOR ART
FIG. 10 is a plan sectional view of a conventional fan with a sound muffling box.

FIG. 9 shows a fourth internal structure of the fan with the sound muffling box according to the exemplary embodiment of the present invention. As shown in FIG. 9, in fan 45 with the sound muffling box, airflow guide 35 is formed integrally with outer plate 38, which is provided on side faces of box 3 and bent to form guide 35.

The following is a description of actions and effects of fan 45 having the above-described configuration. Similar to the case of having sound insulating board 20, if airflow guide 35 is screw-fixed to box 3, the suctioned air flow collides with the gap between airflow guide 35 and box 3, which sometimes causes collision noise (popping noise). When, however, airflow guide 35 is formed integrally with outer plate 38, no gap is formed between airflow guide 35 and box 3, and hence, no collision noise (popping noise) is caused. This configuration also reduces both the number of components and the time required for screw-fixation.

Thus, fan 45 can suppress the generation of suction noise, and be easily assembled.

INDUSTRIAL APPLICABILITY

The fan with a sound muffling box of the present invention can be used not only to transfer air, for example, as a ventilation fan, but also to cool equipment by supplying air through the box outlet port.

The invention claimed is:

1. A fan with a sound muffling box, comprising:

a box having a box inlet port and a box outlet port located on opposite sides from each other;

a double-suction centrifugal fan encased in the box, the double-suction centrifugal fan including:

a motor;

a discharge port inclined toward the box outlet port;

an impeller to be driven by the motor;

a scroll; and a casing side plate, the casing side plate having a motor-side inlet port and an opposite-to-motor-side inlet port opposite to the motor-side inlet port with respect to the impeller, and a sound insulating board disposed on the box inlet port, the sound insulating board being disposed at a position to hide a portion of the opposite-to-motor-side inlet port when an inside of the box is viewed from the box inlet port, the sound insulating board dividing the box inlet port into plural regions, wherein the sound insulating board increases in area from a near side of the motor-side inlet port toward a far side of the motor-side inlet port.

2. The fan with the sound muffling box of claim 1, wherein the sound insulating board has a motor-side end positioned on the near side of the motor-side inlet port and bent in an opposite direction to a direction from the box inlet port toward the box outlet port.

3. The fan with the sound muffling box of claim 1, wherein the sound insulating board is formed integrally with an outer plate of the box.

4. The fan with the sound muffling box of claim 1, further comprising a sound absorber affixed to a face of the sound insulating board, the face being opposite to the double-suction centrifugal fan.

5. The fan with the sound muffling box of claim 1, further comprising a rectangular airflow guide positioned closer to the motor than the sound insulating board, the airflow guide having an end on a side of the sound insulating board, the end being bent toward the inside of the box.

6. The fan with the sound muffling box of claim 5, wherein the airflow guide is formed integrally with an outer plate of the box.

7. The fan with the sound muffling box of claim 5, further comprising a sound absorber affixed to a face of the airflow guide, the face being opposite to the double-suction centrifugal fan.

8. The fan with the sound muffling box of claim 1, wherein the double-suction centrifugal fan is inclined within the case so that motor-side inlet port is hidden by fan casing when the inside of the box is viewed from the box inlet port.

* * * * *